US006309254B1

(12) United States Patent
Korsunsky

(10) Patent No.: US 6,309,254 B1
(45) Date of Patent: Oct. 30, 2001

(54) CARD EDGE CONNECTOR HAVING CROSS-TALK REDUCTION FEATURE

(75) Inventor: Iosif Korsunsky, Harrisburg, PA (US)

(73) Assignee: Tyco Electronics Corportion, Wilmington, DE (US)

( * ) Notice: Subject to any disclaimer, the term of this patent is extended or adjusted under 35 U.S.C. 154(b) by 0 days.

(21) Appl. No.: 09/466,589

(22) Filed: Dec. 17, 1999

Related U.S. Application Data

(60) Provisional application No. 60/112,616, filed on Dec. 17, 1998.

(51) Int. Cl.[7] ..... H01R 24/00
(52) U.S. Cl. ..... 439/637; 439/60
(58) Field of Search ..... 439/637, 60

(56) References Cited

U.S. PATENT DOCUMENTS 4,298,237 11/1981 Griffith et al. ..... 336/17 L
4,993,972 * 2/1991 Lin ..... 439/637
5,071,371 12/1991 Harwath et al. ..... 439/637
5,580,257 * 12/1996 Harwarth ..... 439/108
6,095,821 * 8/2000 Panella et al. ..... 439/60
6,099,328 * 8/2000 Nelson et al. ..... 439/101

* cited by examiner

*Primary Examiner*—Tulsidas Patel
*Assistant Examiner*—Michael C. Zarroli

(57) ABSTRACT

An electrical card edge connector comprising: (a) a housing defining a slot for receiving an edge of a circuit board and a plurality of cavities along the slot for receiving contacts; (b) a plurality of contacts in the cavities. The plurality of contacts has at least a first contact, a second contact, and a third contact, each of which comprises a body and at least one cantilevered arm extending from the body. At least one cantilevered arm of each contact extends into the slot so that when a circuit board is inserted in the slot, a portion of the cantilevered arm of each contact contacts the circuit board. From a viewpoint parallel to the slot, the profile of the body of the first contact overlaps substantially all of the profile of each body of the second and third contacts. Additionally, from this viewpoint, the profile of one or more cantilever arms of the first contact overlaps a substantial portion of the profile of each cantilever arm of the second and third contacts.

7 Claims, 6 Drawing Sheets

CARD EDGE CONNECTOR HAVING CROSS-TALK REDUCTION FEATURE

This application claims the benefit of U.S. Provisional Application No. 60/112,616, filed Dec. 17, 1998.

FIELD OF THE INVENTION

This invention is related to electrical connectors and more particularly to a high-speed card edge receiving electrical connector.

BACKGROUND OF THE INVENTION

With the ever-increasing need for high-speed data signal processing and higher clock speed microprocessors, comes a need to pass high-speed signals through electrical connectors in a system. Also, because of electrical performance concerns and the desire to make devices smaller, comes a need to pass a greater number of high-speed signals through the electrical connectors in a system.

To address these needs, electrical connectors have been developed for connecting peripheral devices on substrates such as printed circuit boards to a system through a card edge receiving electrical connector. These connectors have been developed for connecting to conductive pads disposed along an edge of the printed circuit board. Because of the need for higher density interconnections in these systems, pads are sometimes disposed along the printed circuit board edge in a plurality of rows. For example, U.S. Pat. No. 5,071,371 shows a card edge connector for contacting two parallel rows of pads along a printed circuit board. U.S. Pat. No. 4,298,237 shows a variation of a card edge connector for contacting three parallel rows of contact pads along an edge of a printed circuit board.

A problem exists with these connectors in systems where it is desirable to have a large number of signals passing through such a connector in a minimum space. In order to reduce the space occupied by the connector, it is necessary to have an extremely narrow pitch for the contacts. This translates into less space between each adjacent contact and causes degradation of the electrical signals passing through the connector. The degradation is caused by a cross talk effect between adjacent contacts. As the contacts are moved closer to each other, each contact may be effected by an electromagnetic field emanating from an adjacent contact. The contact receiving the electromagnetic field will have a degraded electrical signal. This is known as cross talk. in order to reduce this effect, ground contacts are typically strategically positioned throughout the connector so that cross talking signals couple to ground instead of coupling to adjacent signals. Since the addition of more ground contact increases the size of the electrical connector it is desirable to select an optimum minimum number of ground contacts and strategically place these contacts to reduce the cross talk effect.

It is therefore desirable to form a dense electrical interconnection between a card edge and a second substrate, which allows passage of many high-speed signals.

SUMMARY

It is an object of the present invention to provide an electrical connector which maximizes the number of high-speed signals which can be passed there through while minimizing the space occupied by the connector.

It is a further object of the invention to provide a card receiving electrical connector capable of connecting to a card edge having a plurality of conductive pads disposed in a plurality of rows along an edge.

It is a further object of the invention to provide an electrical connector having a plurality of signal contacts strategically located in proximity to a plurality of ground contacts such that signal coupling to ground is maximized while signal coupling to other signals is minimized.

These and other objects have been achieved by providing an electrical connector wherein a plurality of ground contacts are disposed in cavities of a housing and a plurality of signal contacts are also disposed in cavity of the housing. The plurality of signal contacts are grouped into two sets. A ground contact is positioned in the housing such that it is adjacent to a signal contact from the first set and also adjacent to a signal contact from the second set along one side of a board-receiving slot. The ground contact is profiled to overlap both sets of adjacent signals contacts when in a deflective state. Also, the contacts are arranged along the board-receiving slot in a staggered pitch such that each signal contact is disposed closer to an adjacent ground than to an adjacent signal contact.

BRIEF DESCRIPTION OF THE DRAWINGS

The invention will now be described by way of example with reference to the accompanying figures of which.

DETAILED DESCRIPTION

Figure 1:
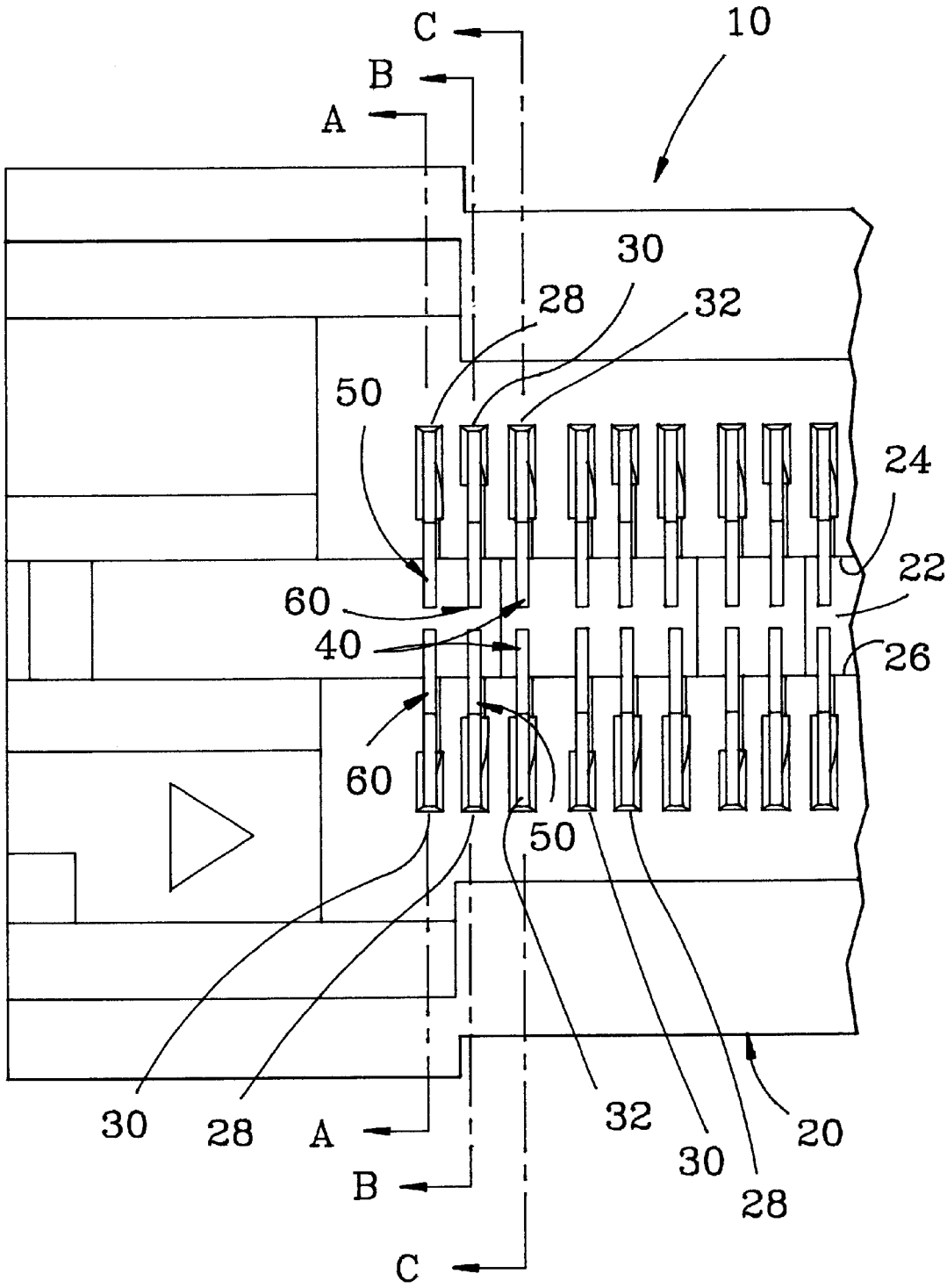
FIG. 1 shows a partial top view of an electrical connector according to the preset invention.

The invention will first be described generally with referenced to FIG. 1 which shows a partial top view of an electrical connector 10 in accordance with the present invention. A housing 20 has a plurality of contact receiving cavities 28,30,32 disposed along opposite sides of a card receiving slot 22. The contact receiving cavities 28,30,32 extend into opposing walls 24,26. A plurality of contacts 40, 50, 60 are each disposed in respective contact receiving cavities 28,30,32. The contacts 40,50,60 extend from the cavities 28,30,32 in the walls 24,26 into the card receiving slot 22 and are matable with a card edge inserted into the slot 22.

Figure 3:
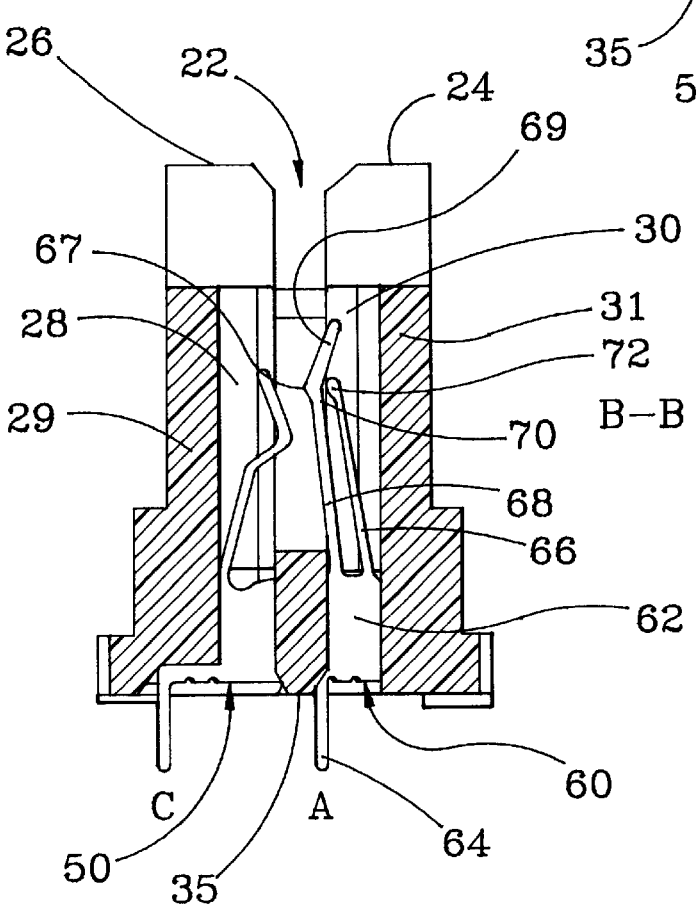
FIG. 3 shows a cross-sectional view of the electrical connector taken along the line B—B of FIG. 1.
Figure 4:
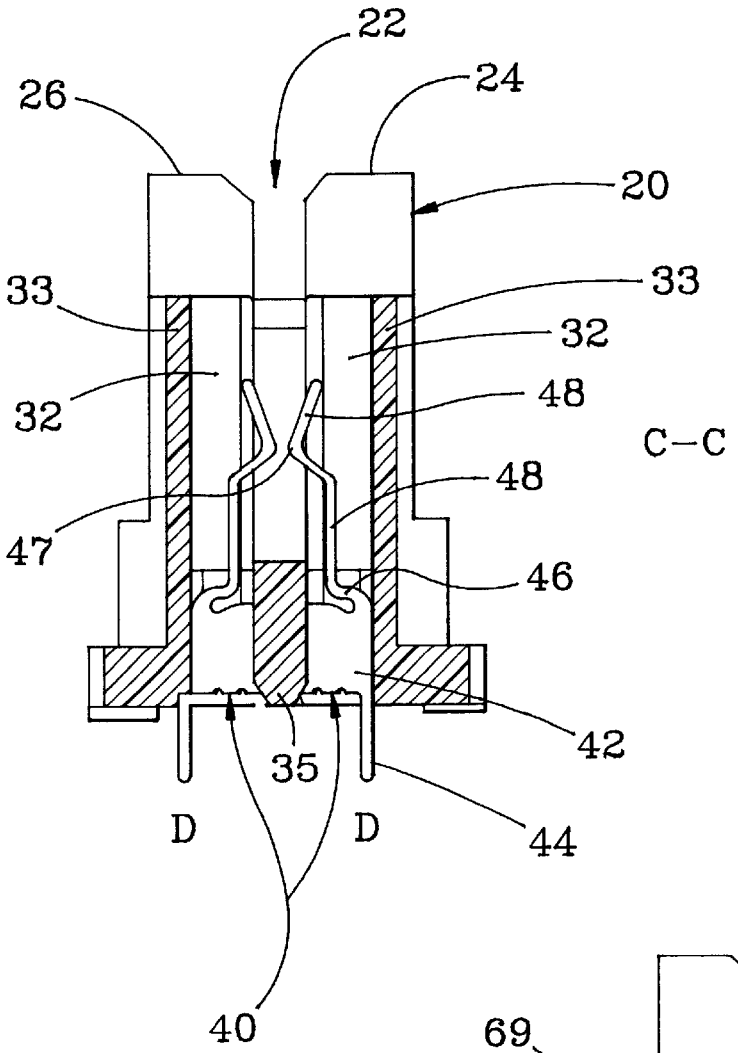
FIG. 4 shows a cross-sectional view of the electrical connector taken along the line C—C of FIG. 1.

Each of the contacts will now be described in greater detail with reference to FIGS. 2–4. Referring first to FIG. 4, the contact 40 is formed of a planar material which may be stamped and includes a main body 42 profiled to have interference sections on opposed sides for engaging walls 33, 35 of the housing. A tail 44 extends downwards from the main body 42. It should be understood that where desirable, the tail 44 could optionally be replaced by a solder foot for surface mount applications. A neck portion 46 extends upwards from the main body 42 and a cantilever arm 48 extends from the neck portion 46. A contact portion 49 extends from the cantilever portion 48 to a free end. A contact point 47 is disposed along the contact section 49 for mating with a pad on a printed circuit board which is inserted into the circuit board receiving slot 22.

Figure 2:
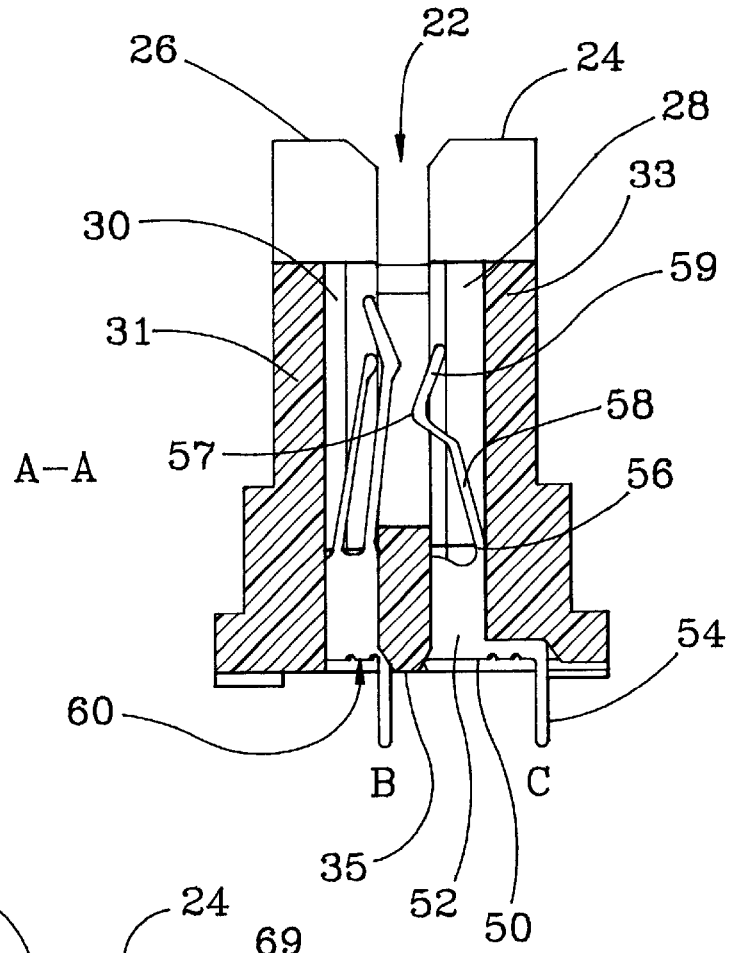
FIG. 2 shows a cross-sectional view of the electrical connector taken along the line A—A of FIG. 1.

Turning now to FIG. 2, contact 50 is formed of a planar material which is stamped to have the features which will now be described. Contact 50 consists of a main body 52 being profiled to have interference sections on opposed sides for engaging walls 33, 35 of the housing. A tail 54 extends downwards from the main body 52. It should be understood that where desirable, the tail 54 could optionally be replaced by a solder foot for surface mount applications. A neck portion 56 extends upwards from the main body 52 and a cantilever arm 58 extends from the neck portion 56. A contact portion 59 extends from the cantilever portion 58 to a free end. A contact point 57 is disposed along the contact section 59 for mating with a pad on a printed circuit board which is inserted into the circuit board receiving slot 22.

The contact 60 will now be described in greater detail with reference to FIG. 3. Contact 60 includes a main body 62 with opposed interference sections for contacting walls 35,31 of the housing. A tail 64 extends downward from the main body 62. It should be understood that while this contact is shown with a tail portion, it may be desirable to replace the tail 64 with a surface mount leg for surface mount applications. A first cantilever arm 68 extends from the main body 62 upward to a contact portion 69 containing a contact point 67. A second cantilever arm 66 extends also from the main body in generally the same direction as the first cantilever arm 68. The cantilever arm 66 has a head 72 at free end, which is disposed, proximate the contact portion 69.

Figure 5:
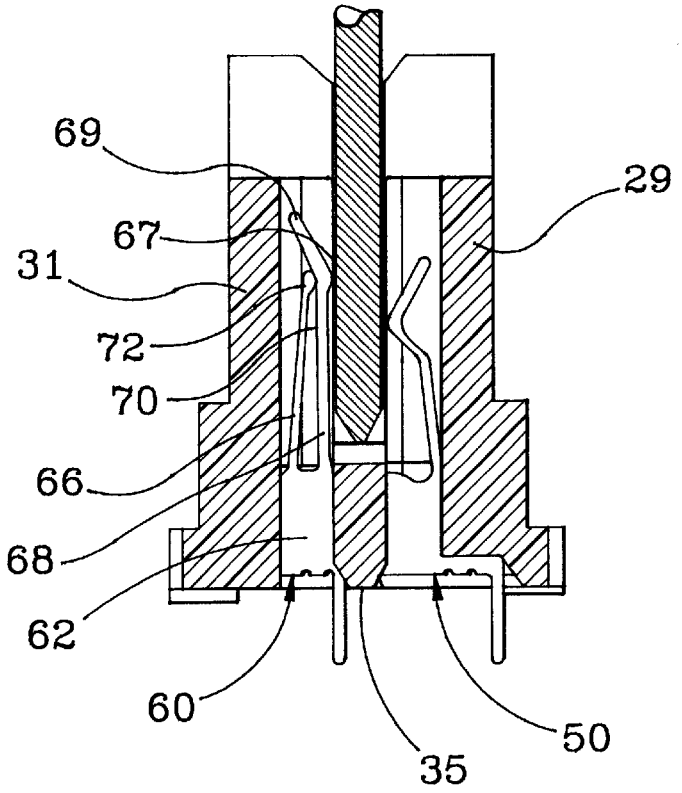
FIG. 5 shows a cross-sectional view similar to that of FIG. 2 wherein a mating board is inserted into the board-receiving slot.
Figure 6:
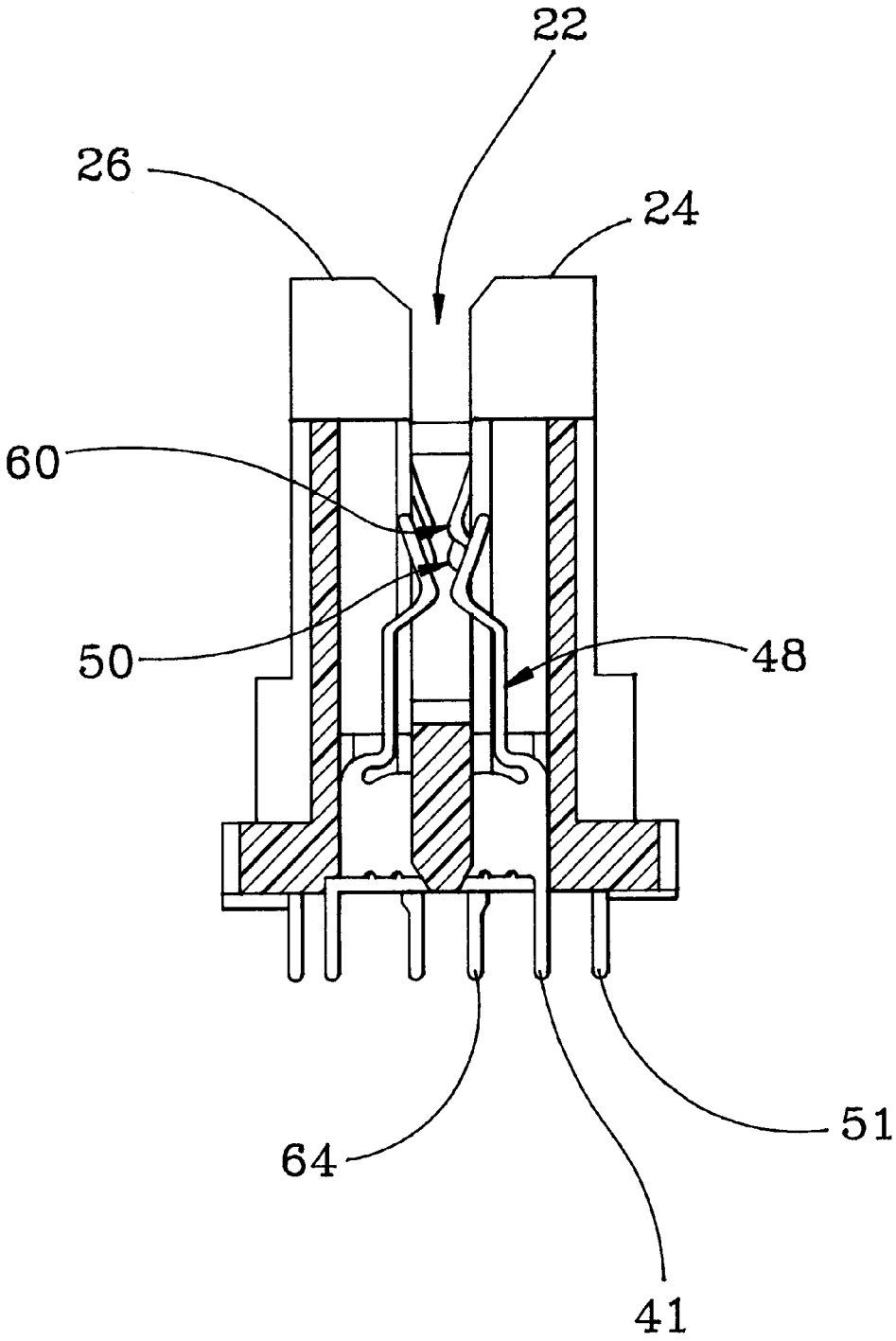
FIG. 6 shows a cross-sectional view similar to that of FIG. 4 having all contacts inserted into the housing cavity.

The contacts 60 when in the deflective state as shown in FIG. 5 will have cantilever beams 66,68 touching each other at the point 70 where the head 72 contacts the cantilever arm 68. The cantilever arm 66 provides added normal force to the contact point 67 when in the deflective state. This reduces insertion forces, provides greater normal force at the contact point 67 and also reduces the material required to achieve this normal force. Additionally, as will be described below, the cantilever arms 66,68 are strategically located for enhanced electrical coupling effects and improved electrical performance.

The positioning of the contact receiving cavities 28,30,32 and the contacts 40,50,60 will now be described in greater detail. It should be noted in FIG. 1 that the contact receiving cavities 28,30,32 are arranged in groups of three at a desired pitch. The space between each group of three is greater than the pitch. The contacts 40,50,60 are arranged in each group of three such that a contact 60 is positioned between the contacts 40 and 50 in each group. The groups of three contacts 40,50,60 are also staggered with respect to each other along the opposed walls 24,26 of the housing 20. As can be seen in FIGS. 2 and 3, each contact 60 is positioned opposite a contact 50. Also, as best seen in FIG. 4, each contact 40 is positioned opposite another contact 40.

Figure 7:
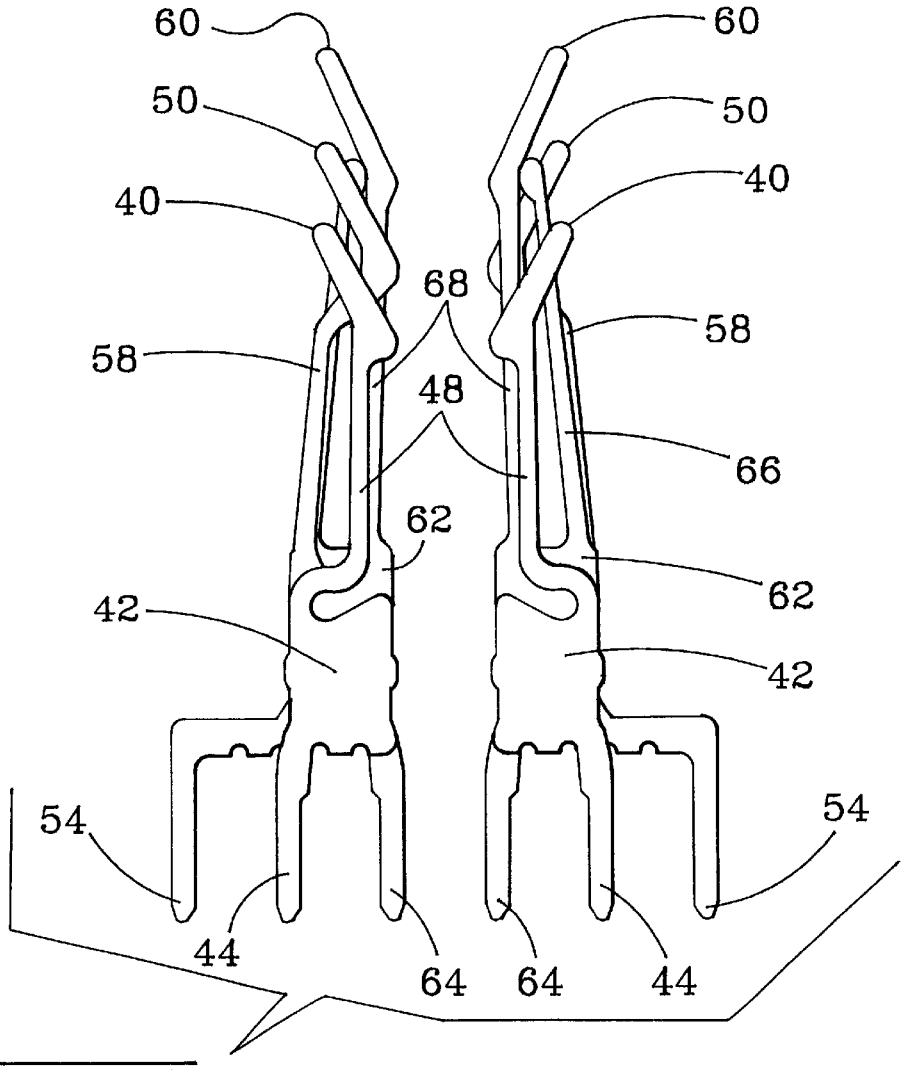
FIG. 7 shows an end view of the contacts, as they would appear in the housing in a deflected state. The housing has been removed for clarity.

Turning now to FIG. 7, two pairs of three contacts 40,50,60 are shown as they would appear in the housing 20. The housing 20 has been removed here for clarity. It should be noted that the contacts are arranged for electrically contacting pads on a mating printed circuit board arranged in three parallel rows along the card edge. Each of the cantilever arms 48,58,66,68 are profiled such that the cantilever arm 66 overlaps the cantilever arm 58 while the cantilever arm 68 overlaps the cantilever arm 48. Also, the main body 62 completely overlaps both of the other main bodies 42,52. These overlapping features provide increased electrical coupling between the signals in the contact 50 and the contact 60 along with increased electrical coupling between the signals in the contact 40 and 60. In this particular application and for illustrative purposes only, the contact 60 is intended for connection to ground. Therefore, coupling each adjacent signal passing the contacts 40,50 to ground while decreasing the coupling between signals passing contacts 40,50 is desirable. The increased space and non-overlap between cantilever arms 48,58 results in a decrease between the signals in contacts 40 and 50.

Figure 8:
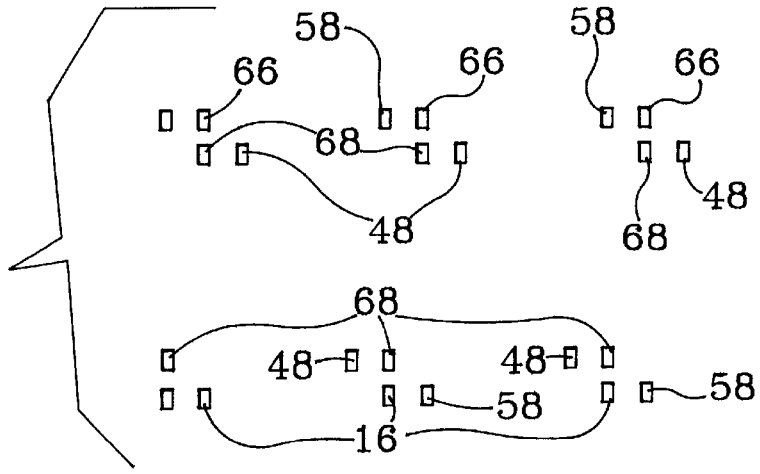
FIG. 8 shows a schematic representation of the contact beam locations as viewed from the mating end of the connector.

These features are also shown schematically in FIG. 8 wherein each rectangle represents the position of a cantilever arm 48,58,66,68 as viewed from the top of the housing similar to FIG. 1. It can be seen that the cantilever arms 66 are closely positioned to the cantilever arms 58 and the cantilever arms 68 are closely positioned to the cantilever arms 48, thus, causing increased coupling between signals in the pair of contacts 40, 60 and the pair 50 and 60. It is also evident that the cantilever arms 48, 58 are shifted in two directions, relative to each other, thus causing a lesser coupling effect between signals passing these contacts relative to each other.

Figure 9:
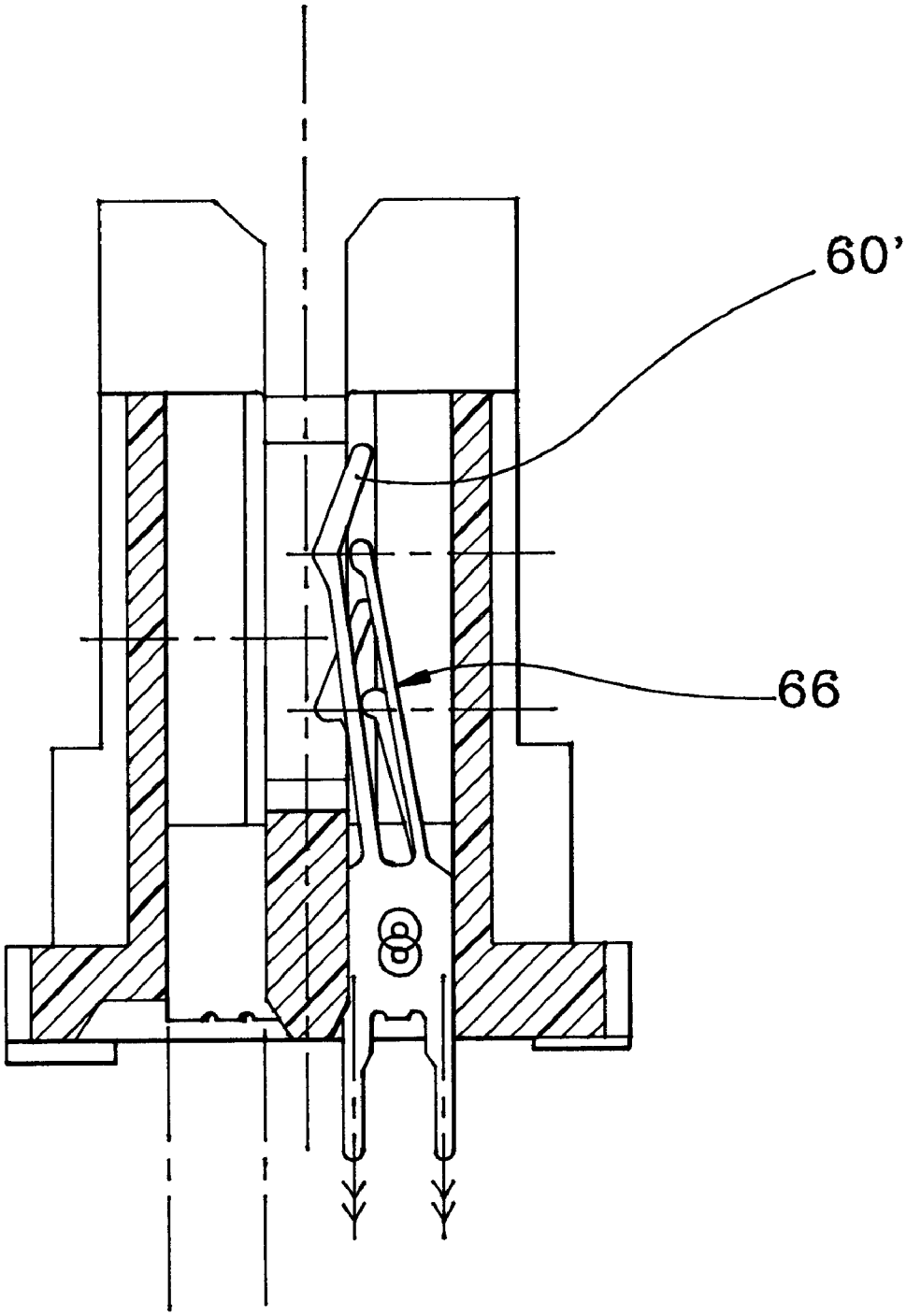
FIG. 9 shows a cross-sectional end view of an electrical contact configuration in accordance with the present invention.

FIG. 9 illustrates a cross-sectional end view of an electrical contact configuration in accordance with another aspect of the present invention where cantilever arm 60' extends from its main body and is angled toward cantilever arm 66.

For purposes of further illustration, assume that the contacts 60 will be electrically connected to ground. Assume also that the contact 40 is connected to a first signal and the contact 50 passes a second signal. The degree of electrical coupling will be defined by Z. $Z_s$ will denote the coupling between adjacent signals 40,50 and $Z_g$ will denote the coupling between signal and ground 46–50 or 50–60. It is desirable that $Z_g<Z_s$. In FIG. 10 it can be seen that this is achieved by strategically positioning each of the contacts 40,50,60 relative to each other. It also should be understood that electrical coupling is a function of the distance between coupling pairs and the overlapping surface area of the contacts for these pairs. It is therefore desirable to maximize overlapping contact area while minimizing distance between contacts in order to maximize the coupling of signals in these contacts. Similarly, the opposite holds true so that if contacts are separated by a greater distance or the surface that overlaps is minimized, coupling will be reduced. In FIGS. 7 and 8, it can be seen that $Z_g$ is maximized by increasing the overlap between the cantilever arms 48,68 and 58,66 and $Z_s$ is minimized by both decreasing the overlap of the cantilever arms 58,48 and maximizing the distance between contacts 40,50.

An advantage of the present invention is that it provides a multilevel card edge connection with improved electrical performance.

An additional advantage is that the invention provides a dense array of electrical connections which maximizes signal coupling to ground while minimizing signal crosstalk, while minimizing the space required for the connector.

What is claimed is:

1. An electrical card edge connector comprising:

a housing defining a slot for receiving an edge of a circuit board and a plurality of cavities along said slot for receiving contacts;

a plurality of contacts in said cavities, said plurality of contacts comprising at least a first contact, a second contact, and a third contact, each of which comprises a body and at least one cantilevered arm extending from said body, at least one cantilevered arm of each contact extending into said slot such that, when a circuit board is inserted in said slot, a portion of a cantilevered arm of each contact contacts said circuit board;

wherein, from a viewpoint parallel to said slot, the profile of the body of said first contact overlaps substantially all of the profile of each body of said second and third contacts; and wherein, from said viewpoint, the profile of one or more cantilever arms of said first contact overlaps a substantial portion of the profile of each cantilever arm of said second and third contacts.

2. An electrical card edge connector comprising:

a housing defining a slot for receiving an edge of a circuit board and a plurality of cavities along said slot for receiving contacts;

a plurality of contacts in said cavities, said plurality of contacts comprising at least a first contact, a second contact, and a third contact, each of which comprises a body and at least one cantilevered arm extending from said body, at least one cantilevered arm of each contact extending into said slot such that, when a circuit board is inserted in said slot, a portion of a cantilevered arm of each contact contacts said circuit board;

wherein, from a viewpoint parallel to said slot, the profile of the body of said first contact overlaps substantially all of the profile of each body of said second and third contacts; and wherein, from said viewpoint, the profile of one or more cantilever arms of said first contact overlaps a substantial portion of the profile of each cantilever arm of said second and third contacts, and the profile of one cantilever arm of said first contact overlaps a substantial portion of the profile of said cantilever arm of said second contact and the profile of another cantilever arm of said first contact overlaps a substantial portion of the profile of said cantilever arm of said third contact.

3. The electrical card edge connector of claim 2, wherein said one cantilevered arm extends into said slot and said another cantilever arm is behind said one cantilevered arm relative to said slot.

4. The electrical card edge connector of claim 3, wherein said one and another cantilevered arms are configured such that, when a card is inserted into said slot, said another cantilevered resists the movement of said one cantilevered arm away from said slot.

5. The electrical card edge connector of claim 4, wherein said first contact is a ground contact and said second and third contacts are signal contacts.

6. The electrical card edge connector of claim 4, wherein said first contact is a ground contact and said second and third contacts are signal contacts.

7. An electrical card edge connector comprising:

a housing defining a slot for receiving an edge of a circuit board and a plurality of cavities along said slot for receiving contacts;

a plurality of contacts in said cavities, said plurality of contacts comprising at least a first contact, a second contact, and a third contact, each of which comprises a body and at least one cantilevered arm extending from said body, at least one cantilevered arm of each contact extending into said slot such that, when a circuit board is inserted in said slot, a portion of a cantilevered arm of each contact contacts said circuit board;

wherein, from a viewpoint parallel to said slot, the profile of the body of said first contact overlaps substantially all of the profile of each body of said second and third contacts;

wherein, from said viewpoint, the profile of one or more cantilever arms of said first contact overlaps a substantial portion of the profile of each cantilever arm of said second and third contacts; and wherein said first contact is a ground contact and said second and third contacts are signal contacts.

* * * * *